US009506311B2

(12) United States Patent
Beisel et al.

(10) Patent No.: US 9,506,311 B2
(45) Date of Patent: Nov. 29, 2016

(54) COUPLING FOR A CEMENT HEAD

(71) Applicant: Halliburton Energy Services, Inc., Houston, TX (US)

(72) Inventors: Joe A. Beisel, Duncan, OK (US); Nicolas Rogozinski, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 228 days.

(21) Appl. No.: 14/366,180

(22) PCT Filed: Aug. 12, 2013

(86) PCT No.: PCT/US2013/054464
§ 371 (c)(1),
(2) Date: Jun. 17, 2014

(87) PCT Pub. No.: WO2015/023248
PCT Pub. Date: Feb. 19, 2015

(65) Prior Publication Data

US 2015/0041116 A1 Feb. 12, 2015

(51) Int. Cl.

| | |
|---|---|
| ***E21B 33/13*** | (2006.01) |
| ***E21B 33/05*** | (2006.01) |
| ***E21B 17/02*** | (2006.01) |

(52) U.S. Cl.
CPC ..... *E21B 33/05* (2013.01); *E21B 17/02* (2013.01); *Y10T 29/49895* (2015.01)

(58) Field of Classification Search
USPC ..... 166/90.1; 29/464
See application file for complete search history.

(56) References Cited

U.S. PATENT DOCUMENTS

| | | | |
|---|---|---|---|
| 4,159,132 | A | 6/1979 | Hitz |
| 5,152,554 | A | 10/1992 | LaFleur et al. |
| 5,441,310 | A | 8/1995 | Barrett et al. |
| 2010/0101792 | A1 | 4/2010 | Rogers et al. |
| 2012/0119490 | A1 | 5/2012 | Beard et al. |
| 2013/0126173 | A1 | 5/2013 | Rogers et al. |

FOREIGN PATENT DOCUMENTS

WO 2015023248 A1 2/2015

OTHER PUBLICATIONS

International Search Report and Written Opinion for PCT/US2013/54464 dated May 19, 2014.

*Primary Examiner* — Taras P Bemko
(74) *Attorney, Agent, or Firm* — McDermott Will & Emery LLP; John Wustenberg

(57) ABSTRACT

Disclosed is an improved coupling for cement heads. One exemplary cement head includes a first module comprising a first end, a first outer surface, and a plurality of first protrusions extending radially outward from the first outer surface, each of the plurality of first protrusions comprising a first profile in which (i) a first engagement surface faces axially away from the first end and (ii) a first support surface forms a first oblique angle relative to an axis; and a bridge configured to engage the plurality of first protrusions.

15 Claims, 7 Drawing Sheets

COUPLING FOR A CEMENT HEAD

This application is a National Stage entry of and claims priority to International Application No. PCT/US2013/054464, filed on Aug. 12, 2013.

BACKGROUND

The present disclosure is related to wellbore servicing tools used in the oil and gas industry and, more particularly, to an improved coupling for cement heads.

During completion of oil and gas wells, cement is often used to solidify a well casing within the newly drilled wellbore. To accomplish this, cement slurry is first pumped through the inner bore of the well casing and either out its distal end or through one or more ports defined in the well casing at predetermined locations. Cement slurry exits the well casing into the annulus formed between the well casing and the wellbore, and is then pumped back up toward the surface within the annulus. Once the cement hardens, it forms a seal between the well casing and the wellbore to protect oil producing zones and non-oil producing zones from contamination. In addition, the cement bonds the casing to the surrounding rock formation, thereby providing support and strength to the casing and also preventing blowouts and protecting the casing from corrosion.

Prior to cementing, the wellbore and the well casing are typically filled with drilling fluid or mud. A cementing plug is then pumped ahead of the cement slurry in order to prevent mixing of the drilling mud already disposed within the wellbore with the cement slurry. When the cementing plug reaches a collar or shoulder stop arranged within the casing at a predetermined location, the hydraulic pressure of the cement slurry ruptures the plug and enables the cement slurry to pass through the plug and then through either the distal end of the casing or the side ports and into the annulus. Subsequently, another cementing plug is pumped down the casing to prevent mixing of the cement slurry with additional drilling mud that will be pumped into the casing following the cement slurry. When the top cementing plug lands on the collar or stop shoulder, the pumping of the cement slurry ceases.

To perform the aforementioned cementing operations, a cement head or cementing head is usually employed. The cement head is arranged at the surface of the wellbore and the cementing plugs are held within the cement head until the cementing operation requires their deployment. The cement head must be able to withstand enormous tensile forces along its entire length attributable to the overall weight of the work string coupled to the cement head and extended into the wellbore. In some cases, the cement head and its various internal connections may be required to bear several million pounds of tensile force.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

For a more complete understanding of the present disclosure, and for further details and advantages thereof, reference is now made to the accompanying drawings, wherein.

DETAILED DESCRIPTION

The present disclosure is related to wellbore servicing tools used in the oil and gas industry and, more particularly, to an improved coupling for cement heads.

The present disclosure provides embodiments of a cement head that maximize or increase its tensile load capabilities within limited clamping space. More specifically, the disclosed embodiments describe cement head couplings that are configured to support high axial loads from the weight of system components. The couplings may be configured with engagement surfaces positioned and oriented to receive an axial load from a bridge in a direction toward a connecting module. Such engagement surfaces serve to accommodate axial loads applied to adjacent modules in opposite directions. The disclosed coupling interfaces include a plurality of shear lugs or protrusions configured to support high axial loads. The shear lugs or protrusions may also be able to accommodate distributions of loads across protrusions that are non-uniform and otherwise provide the capability to support a share of a total load applied on the cement head.

Figure 1:
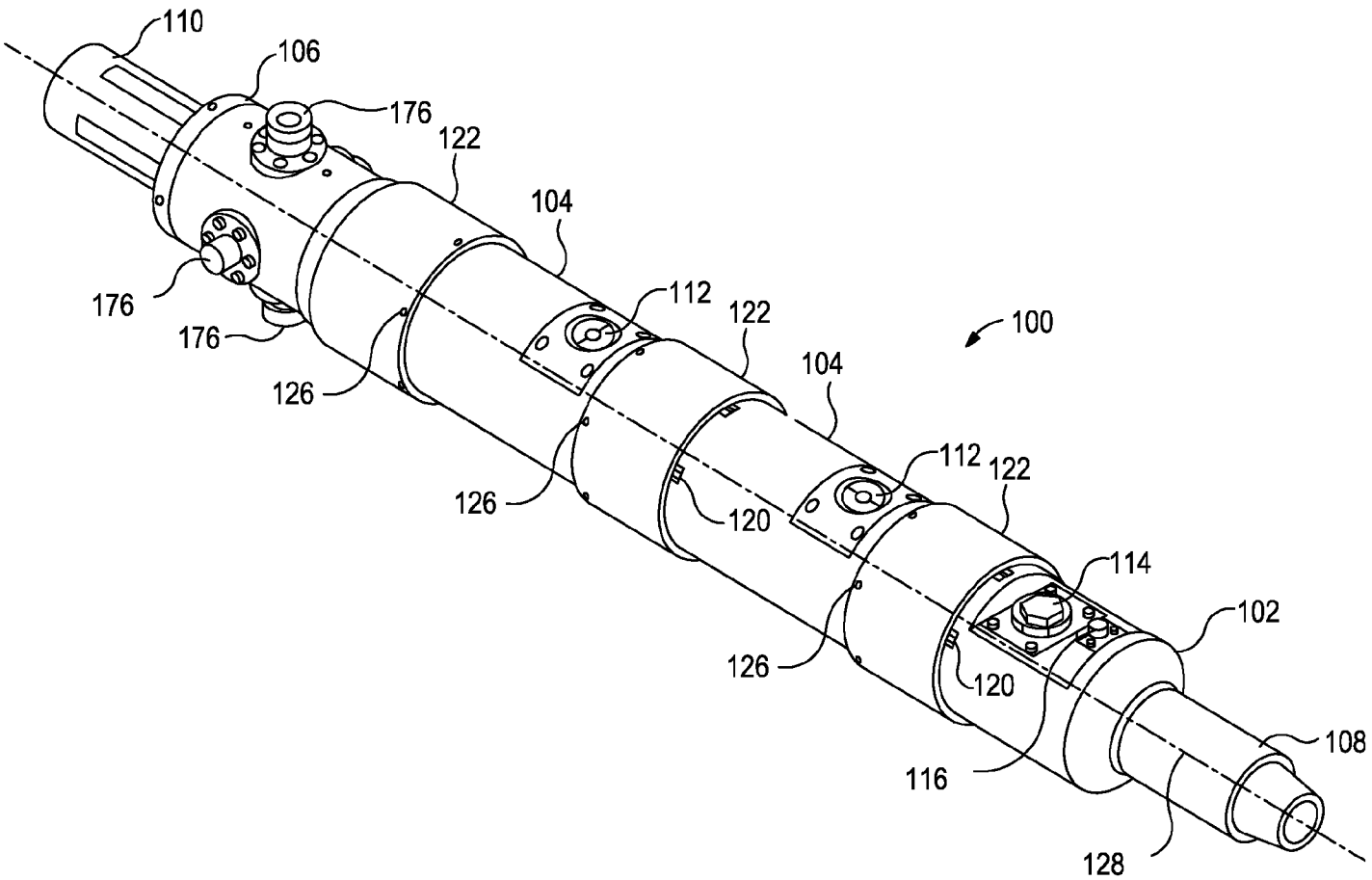
FIG. 1 is an oblique view of a cement head according to an embodiment.

Referring to FIG. 1, illustrated is a cement head 100 that may embody principles of the present disclosure, according to one or more embodiments. While the cement head 100 is shown as having a particular configuration and design, those skilled in the art will readily recognize that other types and designs of cement heads may equally be used and otherwise employ the principles of the present disclosure. The cement head 100 is generally a multi-function device for use inline with a work string associated with a wellbore in a hydrocarbon fluid production well. Most generally, the cement head 100 is used to deliver cement or other wellbore servicing fluids and/or mixtures to a wellbore through the work string to which the cement head 100 is attached. The cement head 100 is also capable of delivering darts and/or balls for activating or initiating some function of a tool or structure associated with the work string.

The cement head 100 comprises an output module 102, intermediate modules 104, and an input module 106. Each of the output module 102, intermediate modules 104, and input module 106 have a substantially cylindrical outer profile and each lie substantially coaxial with a central axis 128 that extends generally along the length of the cement head 100 and is generally located centrally within cross-sections of the cement head 100 that are taken orthogonal to the central axis 128. Each intermediate module 104 comprises a launch valve 112. The output module 102 comprises a launch port 114 and a launch indicator 116. The output module 102 further comprises a lower work string interface 108. The input module 106 comprises an upper work string interface 110 and/or one or more mixture ports 176.

Figure 2:
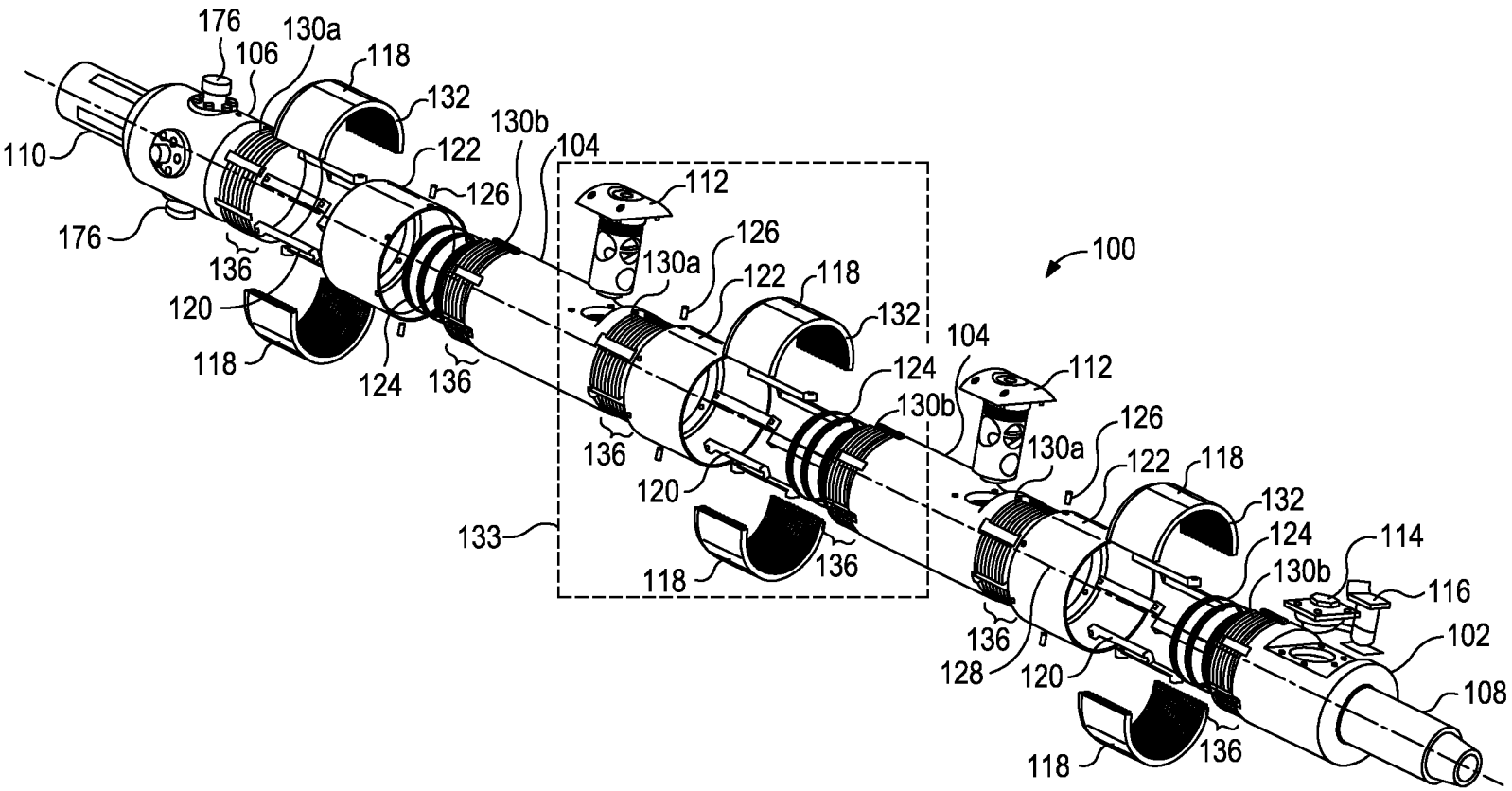
FIG. 2 is an oblique exploded view of the cement head of FIG. 1.

Referring to FIG. 2, with continued reference to FIG. 1, the cement head 100 is configured to withstand enormous tensile forces along the length of the cement head 100. The high tensile forces are generally attributable to the overall weight of the work string connected to the cement head 100 below the output module 102. The connections between the output module 102, intermediate modules 104, and input module 106 are required to be robust. Such robust connections are accomplished using bridges 118, keys 120, retainers 122, seals 124, and lock screws 126, in combination with structural features of the output module 102, intermediate modules 104, and input module 106 themselves.

The output module 102, intermediate modules 104, and input module 106 comprise primary outer profiles 130 (shown in FIG. 2 as profiles 130*a*, 103*b* and 130*c*) that interact with bridges 118 to aid in forming the connections between the modules 102, 104, 106. Particularly, the primary outer profiles 130*a-c* interact with complementary profiles 132 of bridges 118, which help transfer tensile forces between adjacent modules 102, 104, 106. Further, keys 120 are used to prevent relative rotation between adjacent modules 102, 104, 106 while also transferring torque between adjacent modules 102, 104, 106. Finally, retainers 122 are used to guarantee continued interaction between the primary outer profiles 130 and the complementary profiles 132 while lock screws 126 aid in securing the retainers 122 relative to the bridges 118. In alternative embodiments, any other suitable device or method may be used to secure the retainers 122 relative to the bridges 118. A portion of the cement head 100 is illustrated as being bounded by a box 133. The portion of the cement head 100 bounded by the box 133 is shown in greater detail as FIG. 3.

Figure 3:
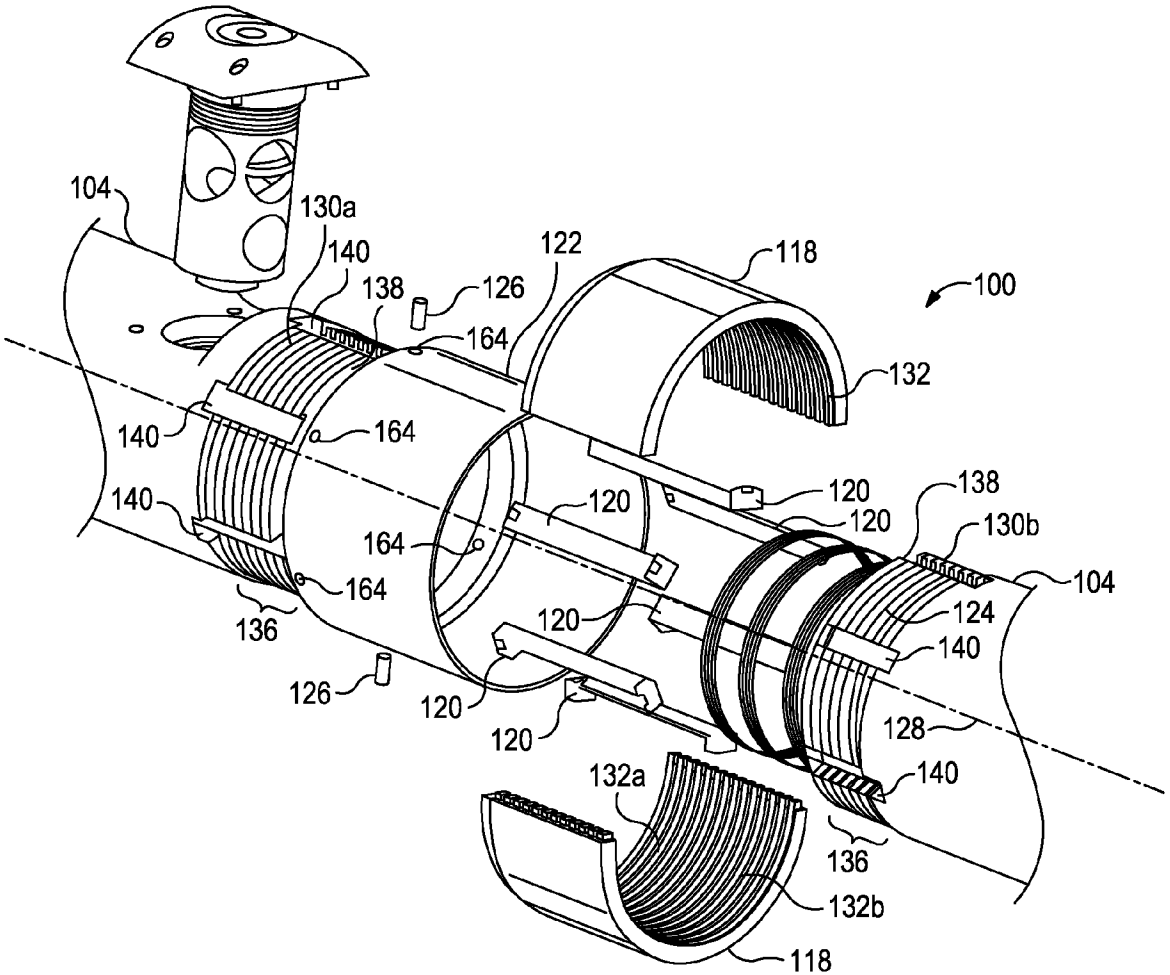
FIG. 3 is an oblique exploded view of a portion of the cement head of FIG. 1.

FIG. 3 shows a portion of the cement head 100 in greater detail. Specifically, FIG. 3 is an exploded view showing the portion of the cement head 100 where the two intermediate modules 104 are adjacent. The modules 102, 104, 106 include engagement sections 136, which are lengthwise portions of the modules 102, 104, 106 that are located near and abut with adjacent modules 102, 104, 106 as shown in FIGS. 2 and 3. The engagement sections 136 comprise protrusions 138 that extend radially away from the central axis 128 and are longitudinally offset from each other along the central axis 128. More specifically, the protrusions 138 are shaped as annular rings that, when viewed in a cross-section taken through the central axis 128, have profiles generally extending from the outer surface of the engagement sections 136 and away from the central axis 128. Each annular ring provides a ridge that extends at least partly about a circumference at a fixed location. According to some embodiments, the protrusions 138 follow annular, rather than helical, paths.

As shown in FIG. 3, each protrusion 138 is separated into a plurality of discrete angular segments about the central axis 128 by slots 140. The slots 140 are substantially formed as rectangular recesses that extend longitudinally along the length of the modules 102, 104, 106 from the free ends of the engagement sections 136 into the full diameter sections. The slots 140 also extend radially inward from the outer surfaces of the engagement sections 136 toward the central axis 128, thereby providing an inward depth to the slots 140.

Figure 4:
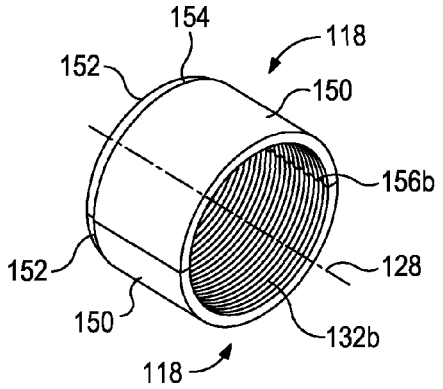
FIG. 4 is an oblique view of a bridge of the cement head of FIG. 1.
Figure 5:
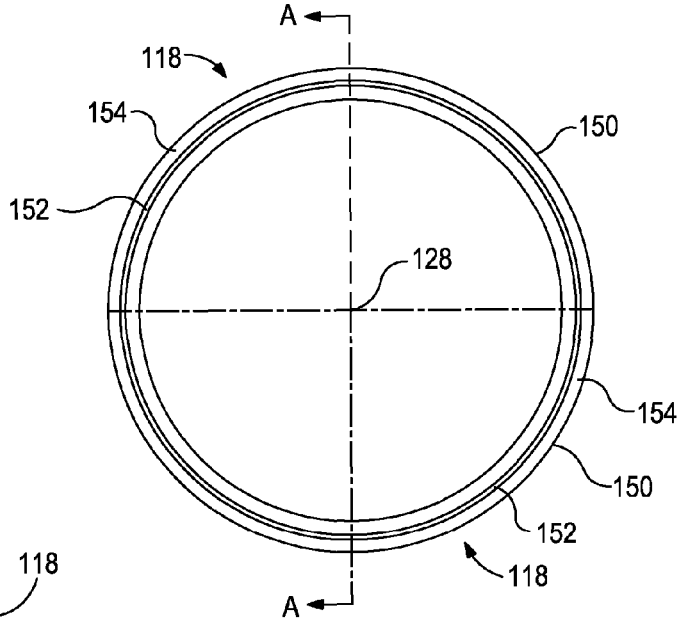
FIG. 5 is an orthogonal end view of the bridge of FIG. 4.
Figure 6:
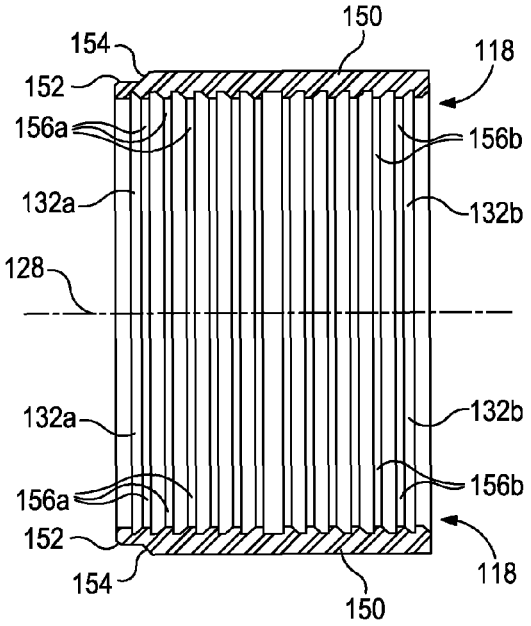
FIG. 6 is an orthogonal cross-sectional view of the bridge of FIG. 5.

Referring now to FIGS. 4-6 (and FIGS. 9-12), two bridges 118 are shown in greater detail, according to one or more embodiments. Each bridge 118 includes generally the same features and is illustrated as having substantially similar structure. Each bridge 118 may be formed as a cylindrical tubular half-shell, such that when the two bridges 118 are located adjacent each other in a properly installed orientation, they substantially form a cylindrical tubular member. Each bridge 118 comprises an outermost surface 150 that, in this embodiment, is a cylindrical surface. Each bridge 118 further comprises a reduced outer surface 152, a cylindrical surface having a smaller diameter than the outermost surface 150, joined to the outermost surface by a bevel 154.

As previously discussed, the bridges 118 further comprise first and second complementary profiles 132 (shown as profiles 132*a* and 132*b*). The complementary profiles 132*a* and 132*b* comprise complementary protrusions 156*a* and 156*b*, respectively. The complementary protrusions 156*a* and 156*b* extend radially toward the central axis 128 and are longitudinally offset from each other along the central axis 128. More specifically, the complementary protrusions 156*a* and 156*b* are generally shaped as annular rings that, when viewed in a cross-section taken through the central axis 128, appear as polygonal protrusions extending from the inner surface of the bridge 118, toward the central axis 128. Each annular ring provides a ridge that extends at least partly about a circumference at a fixed location. According to some embodiments, the protrusions 156*a* and 156*b* follow annular, not helical, paths. Taken together, the complementary protrusions 156*a* and 156*b* of the bridge 118 form a series of ridges that are offset longitudinally.

The complementary profiles 132*a* and complementary protrusions 156*a* of a bridge 118 are termed such because, at least generally, their shape and size complements the respective primary outer profiles 130*a* and protrusions 138 of a first module 104 (FIGS. 1-3). More specifically, the complementary profiles 132*a* complement the primary outer profiles 130*a* so that tensile forces generally parallel to the central axis 128 are sufficiently transferred between adjacent modules 102, 104, 106 through bridges 118.

Likewise, the complementary profiles 132*b* and complementary protrusions 156*b* of a bridge 118 are termed such because, at least generally, their shape and size complements the respective primary outer profiles 130*b* and protrusions 138*b* of a second module 104 (FIGS. 1-3). More specifically, the complementary profiles 132*b* complement the primary outer profiles 130*b* so that tensile forces generally parallel to the central axis 128 are sufficiently transferred between adjacent modules 102, 104, 106 through bridges 118.

Figure 7:
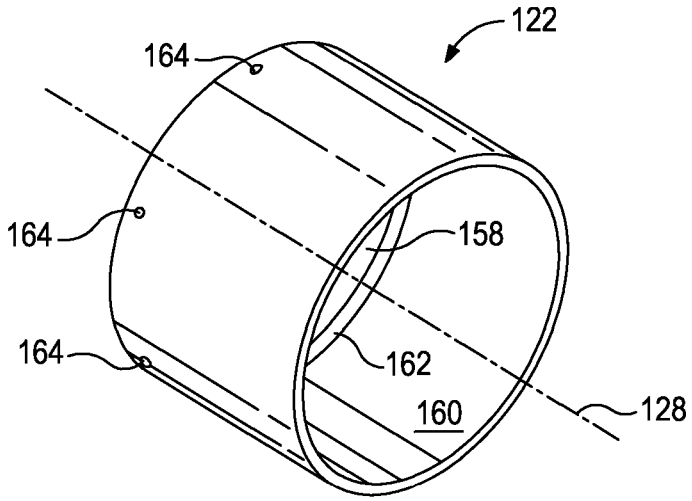
FIG. 7 is an oblique view of a retainer of the cement head of FIG. 1.
Figure 8:
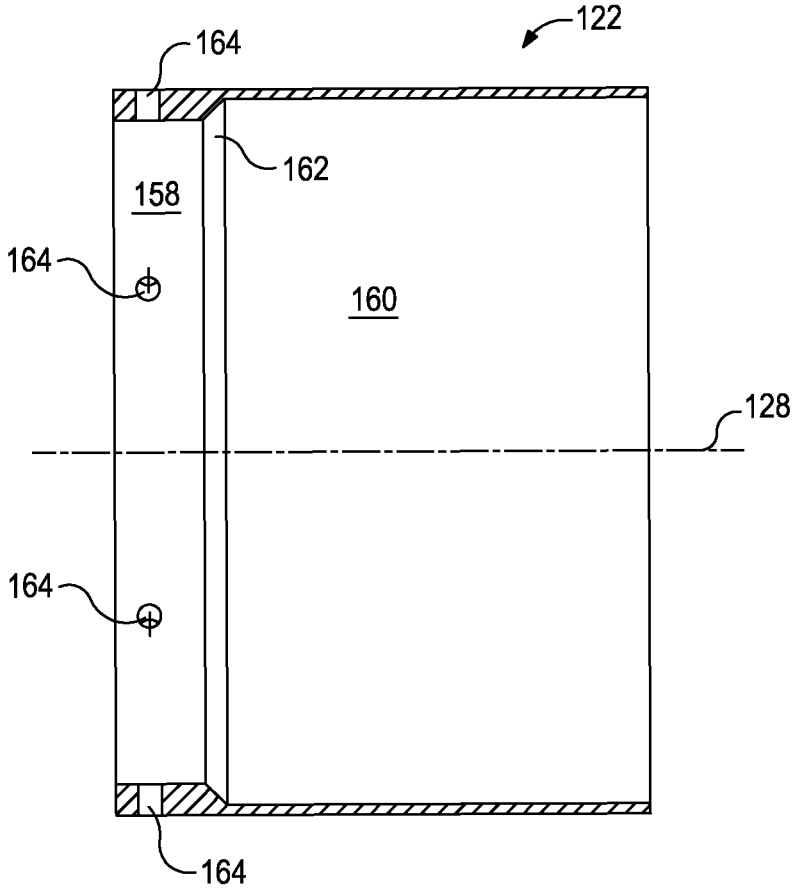
FIG. 8 is an orthogonal cross-sectional view of the retainer of FIG. 7.

Referring now to FIGS. 7 and 8, a retainer 122 is shown. The retainer 122 is formed substantially as a tubular cylindrical member having a cylindrical outer retainer surface. The interior of the retainer 122 substantially complements the combined shape of the exteriors of the bridges 118. More specifically, the retainer 122 comprises an innermost surface 158 connected to an enlarged inner surface 160 by a complementary bevel 162. When the cement head 100 is fully assembled as show in FIG. 1, the retainer 122 substantially surrounds the bridges 118 with the outermost surface 150 facing the enlarged inner surface 160, the reduced outer surface 152 facing the innermost surface 158, and with the complementary bevel 162 facing the bevel 154 (FIGS. 4 and 5). The retainer 122 further comprises retainer apertures 164 for receiving lock screws 126 (FIG. 2) therethrough.

Figure 9:
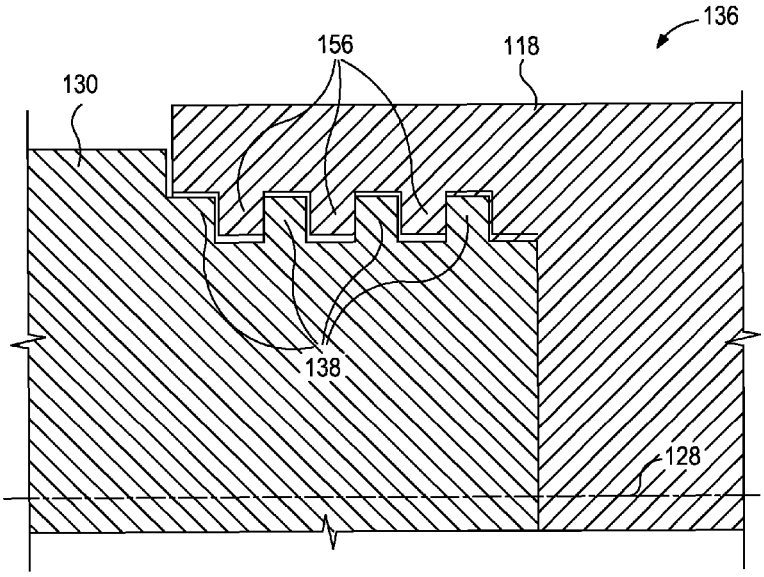
FIG. 9 is an orthogonal cross-sectional view of a portion of the cement head.

Referring now to FIG. 9, with continued reference to FIGS. 3-6, illustrated is an exemplary engagement section 136. More particularly, the engagement section 136 includes a bridge 118 being coupled to an outer profile 130 of at least one of the modules 102, 104, and 106 of FIGS. 1 and 2. The protrusions 138 of the outer profile 130 may be shaped as annular rings that, when viewed in a cross-section taken through the central axis 128, appear as rectangular protrusions extending from the outer surface of the outer profile 130 and away from the central axis 128. In this embodiment, each protrusion 138 is separated into a plurality of discrete annular segments that extend about the central axis 128. As illustrated, each protrusion or annular segment may be formed as rectangular recesses and protrusions, so as to generally take the form of ACME threads or the like.

The complementary profiles 132 of the bridge 118 comprise complementary protrusions 156. The complementary protrusions 156 may extend radially toward the central axis 128 and are longitudinally offset from each other along the central axis 128. More specifically, the complementary protrusions 156 may also be shaped as annular rings that, when viewed in a cross-section taken through the central axis 128, appear as protrusions extending from the inner diameter of the bridge 118, toward the central axis 128.

The protrusions 138 and 156 are required to support heavy loads relating to the cement head 100 as well as other wellbore equipment and components. Such loads are transferred between the protrusions 156 of the bridge 118 and the protrusions 138 of the outer profile 130. An aspect of the present disclosure provides enhanced axial support and load distribution.

Figure 10:
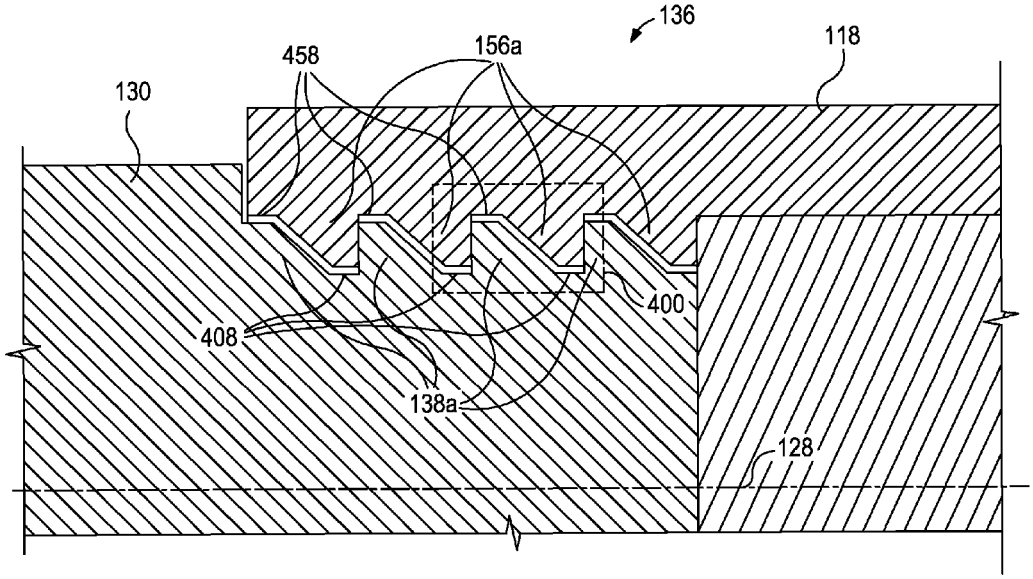
FIG. 10 is an orthogonal cross-sectional view of a portion of the cement head of FIG. 1.

For example, referring now to FIG. 10, with continued reference to FIGS. 3-6 and FIG. 9, illustrated is another exemplary engagement section 136, according to one or more embodiments of the disclosure. As shown in FIG. 10, a plurality of protrusions **138*a* extends radially outward from the outer surface 408 of the outer profile 130. When viewed in a cross-section taken through the central axis 128, each of the protrusions 138*a* defines the outer profile 130. A plurality of complementary protrusions 156*a* are also depicted as extending radially inward toward the central axis 128 from an inner surface 458 of the bridge 118**.

Figure 11:
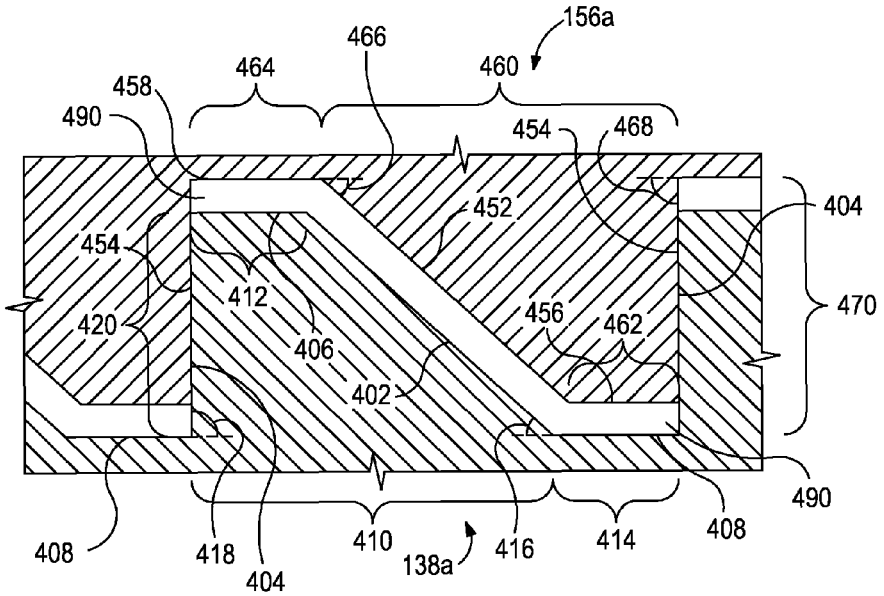
FIG. 11 is an orthogonal cross-sectional view of a portion of the cement head of FIG. 1.

Referring to FIG. 11, illustrated is the enlarged portion 400 of the engagement section of FIG. 10, as indicated by the dashed box of FIG. 10. As illustrated, a protrusion **138*a* of the outer profile 130 provides, in a profile, a support surface 402 that may form an angle 416 with the outer surface 408 (or the central axis 128). The angle 416 may be between about 0° and about 90°, exclusive of 0° and 90°, such that the support surface 402 is oblique relative to the outer surface 408 (or the central axis 128). As used herein, items that are oblique are neither perpendicular nor parallel to one another. For example, the angle 416 may be about or exactly 5°, 10°, 15°, 20°, 25°, 30°, 35°, 40°, 45°, 50°, 55°, 60°, 65°, 70°, 75°, 80°, or 85°. By further example, the angle 416** may be between about 40° and about 50°.

As further shown in FIG. 11, the protrusion **138*a* provides, in a profile, an engagement surface 404 having a height 420 and forming an angle 418 with the outer surface 408 (or the central axis 128). According to some embodiments, the angle 418 may be equal to or about equal to 90°, such that the engagement surface 404 is substantially perpendicular relative to the outer surface 408 (or the central axis 128). According to some embodiments, the angle 418 is not equal to the angle 416. According to some embodiments, the sum of the angles 416 and 418 is not 180° (i.e., the angles 416 and 418 are not supplementary). According to some embodiments, the support surface 402 and the engagement surface 404 are not parallel. According to some embodiments, the protrusion 138*a*** does not form, in a profile thereof, an isosceles trapezoid, a rectangle, a rhombus, a parallelogram, or a square.

According to some embodiments, at least a portion of the support surface 402, engagement surface 404, or top surface 406 is flat, convex, or concave. According to some embodiments, transitions between (i) the support surface 402 and the top surface 406, (ii) the top surface 406 and the engagement surface 404, (iii) the engagement surface 404 and the outer surface 408, or (iv) the outer surface 408 and the support surface 402 are sharp, angular, curved, beveled, smooth, or stepwise.

As further shown in FIG. 11, the protrusion **138*a* includes a base, adjacent to the outer surface 408 and having a width 410, and a top surface 406, having a width 412. The width 410 of the base exceeds the width 412 of the top surface 406. The top surface 406 may be disposed (i) axially between the engagement surface 404 and the support surface 402 and (ii) radially outward from the outer surface 408 (or the central axis 128). The top surface 406 may be parallel to the outer surface 408 (or the central axis 128) or form a non-zero angle relative to the outer surface 408 (or the central axis 128**).

As further shown in FIG. 11, the protrusion **156*a* provides, in a profile, a support surface 452 forming an angle 466 with the inner surface 458 (or the central axis 128). The angle 466 may be between 0° and 90°, such that the support surface 452 is oblique relative to the inner surface 458 (or the central axis 128). For example, the angle 466 may be about 5°, 10°, 15°, 20°, 25°, 30°, 35°, 40°, 45°, 50°, 55°, 60°, 65°, 70°, 75°, 80°, or 85°. By further example, the angle 466 may be between about 40° and about 50°. At least a portion of the support surface 452** may be flat, convex, or concave.

As further shown in FIG. 11, the protrusion **156*a* provides, in a profile, an engagement surface 454 having a height 470 and forming an angle 468 with the inner surface 458 (or the central axis 128). According to some embodiments, the angle 468 may be equal to or about equal to 90°, such that the engagement surface 454 is substantially perpendicular relative to the inner surface 458 (or the central axis 128). According to some embodiments, the angle 468 is not equal to the angle 466. According to some embodiments, the sum of the angles 466 and 468 is not 180° (i.e., the angles 466 and 468 are not supplementary). According to some embodiments, the support surface 452 and the engagement surface 454 are not parallel. According to some embodiments, the protrusion 156*a*** does not form, in a profile thereof, an isosceles trapezoid, a rectangle, a rhombus, a parallelogram, or a square.

As further shown in FIG. 11, the protrusion **156*a* includes a base, adjacent to the inner surface 458 and having a width 460, and a top surface 456, having a width 462. The width 460 of the base exceeds the width 462 of the top surface 456. The top surface 456 may be disposed (i) axially between the engagement surface 454 and the support surface 452 and (ii) radially inward from the inner surface 458 (or toward the central axis 128). The top surface 456 may be parallel to the inner surface 458 (or the central axis 128) or form a non-zero angle relative to the inner surface 458 (or the central axis 128**).

Engagement of the bridge 118 with the outer profile 130 occurs between contacting pairs of engagement surfaces 404 and 454. Pairs of angles 416 and 466 may be equal yet oblique relative to the central axis 128. Accordingly, pairs of adjacent support surfaces 402 and 452 may be parallel. Pairs of angles 418 and 468 may be equal (e.g., 90°) relative to the central axis 128. Accordingly, pairs of adjacent engagement surfaces 404 and 454 may be parallel. During operation, an axially directed load is transferred between engagement surfaces 404 and 454. In some embodiments, a gap 490 may appear between adjacent top surfaces 406 and 456 and/or between outer surface 408 and inner surface 458. The gap 490 may extend between support surfaces 402 and 452 and have a length 414/464. The retainer 122 may provide a radial or other force to maintain the bridges 118 in engagement with the modules 102, 104, or 106.

According to some embodiments, the support surface 402 of a protrusion 138*a* and the support surface 452 of a protrusion 156*a* may at least partially overlap along the axis. Accordingly, the width 410 at the base of the protrusion 138*a* and the width 460 at the base of the protrusion 156*a* may partially overlap along the axis. Thus, the same axial length may be utilized by the protrusion 138*a* and the protrusion 156*a* to provide a greater width 410 and width 460, respectively. Thus, the sum of the widths 410 and 460 is greater than a combined axial distance from the engagement surface 404 of the protrusion 138*a* to the engagement surface 454 of the protrusion 138*b*. At least part of the combined axial distance is occupied by portions of both support surfaces 402 and 452. The load is distributed across greater maximum axial widths 410, 460 than would be provided by rectangular profiles having the same combined axial distance across a pair of rectangular profiles. As such, the protrusions 138*a* and 156*a* are able to support greater loads, with less deformation, than would be achieved if the same load were applied to rectangular protrusions occupying the same axial length of space.

As will be appreciated, the increased axial widths 410, 460 and taper of the protrusions 138*a*, 156*a*, respectively, effectively increases the shear area over the same length of the bridge 118 as compared with prior designs (e.g., FIG. 9). Again, it should be noted that the protrusions 138*a* and 156*a* are not utilized in a threaded connection or engagement but instead in a complementary, annular engagement. For instance, a threaded connection would be unable to utilize the proportionately increased widths 410, 460 to match the force applied per protrusion 138*a*, 156*a* due to tool stretch.

Figure 12:
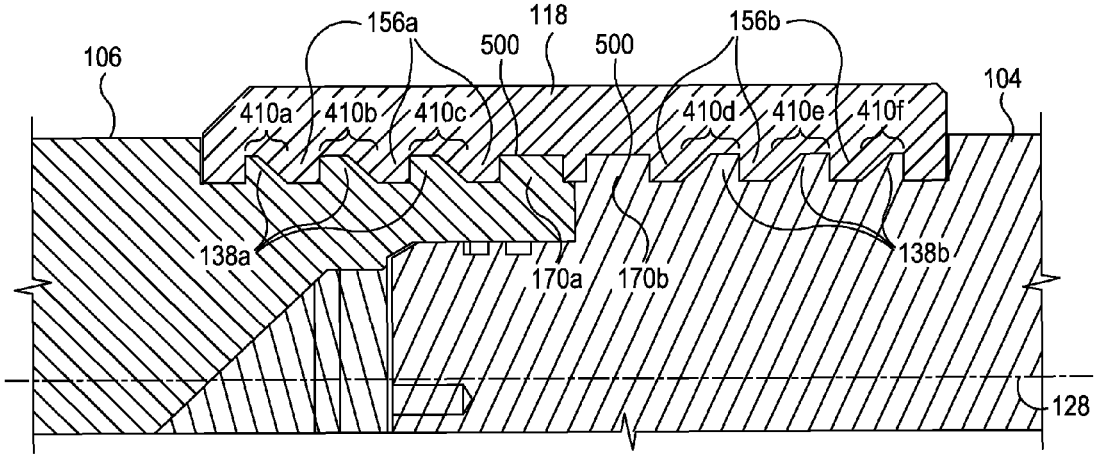
FIG. 12 is an orthogonal cross-sectional view of a portion of the cement head of FIG. 1.

According to some embodiments, as shown in FIG. 12, a module 106 (or any of the modules 102 and 104 in FIGS. 1 and 2) may provide a first set or plurality protrusions 138*a* and another module 104 (or any other module) may provide second set or plurality of protrusions 138*b*. The first protrusions 138*a* and the second protrusions 138*b* may be distributed along a common axis 128 when the module 104 and the module 106 are aligned and joined. The bridge 118 may provide first protrusions 156*a* for engagement with the first protrusions 138*a* and second protrusions 156*b* for engagement with the second protrusions 138*b*.

Accordingly, the first and second protrusions 138*a,b* may have corresponding profiles that differ with respect to orientation of the support surfaces. For example, the first protrusions 138*a* may have a first profile and the second protrusions 138*b* have a second profile that is substantially a mirror image of the first profile. The support surfaces of the first protrusions 138*a* each face in a first direction, having a first axial component. The support surfaces of the second protrusions 138*b* each face in a second direction, having a second axial component, opposite the first axial component. The respective support surfaces may be non-parallel. Likewise, the respective directions in which the support surfaces face may be non-parallel.

A load transferred by the bridge 118 to each of the modules is received on the corresponding engagement surfaces. The engagement surfaces, having defined orientations and surface areas, are optimized to receive the load. Where each load received by a module 102, 104, 106 is unidirectional, the engagement surfaces are oriented to receive the load and the support surfaces are oriented to support the protrusion while minimizing the space occupied by the protrusion.

The angled support surfaces of the protrusions 138*a*, 138*b*, 156*a*, and 156*b* provide more shear resistance within a given axial length of the protrusion. Adjacent pairs of protrusions 138*a* and 156*a* may overlap at least partially along the axis 128. Likewise, adjacent pairs of protrusions 138*b* and 156*b* may overlap at least partially along the axis 128. As such, adjacent pairs of protrusions each provide a greater maximum axial length relative to protrusions with complementary rectangular profile shapes (e.g., FIG. 9).

According to some embodiments, as shown in FIG. 12, the module 106 comprises a first supplemental protrusion 170*a*, and the module 104 comprises a second supplemental protrusion 170*b*. Each of the supplemental protrusions 170*a* and 170*b* may have a cross-sectional profile that is distinct from both of the profiles of protrusions 138*a* and 138*b*. The supplemental protrusions 170*a* and 170*b* may have cross-sectional profiles that are similar or identical to each other. The bridge 118 may provide corresponding recesses 500 that are configured to receive or engage the supplemental protrusions 170*a* and 170*b*.

It has further been found that, relative to other protrusions, each protrusion along an axial length of a module 102, 104, 106 supports a disproportionate amount of a total load applied to the module 102, 104, 106. It has been found that, for at least some modules, protrusions closer to a source of a load support a greater proportion of the total load. For example, the following percent loads were measured for a module 106 having four protrusions, numbered in order of increasing distance from a set of protrusions of a neighboring module 104 to which the module 106 was coupled:

TABLE 1

| Percent Load per Protrusion of Input Module 106 (female) | |
|---|---|
| Protrusion 138a (#) | Load (% of Total) |
| 1 | 13 |
| 2 | 19 |
| 3 | 32 |
| 4 | 35 |
| Total | 100 |

As shown, the fourth protrusion 138*a*, closest to the protrusions 138*b* of a neighboring module 104, received the greatest proportion of the total load. In contrast, the first protrusion 138*a*, farthest from the protrusions 138*b* of a neighboring module 104, received the greatest proportion of the total load. According to some embodiments, as shown in FIG. 12, a first maximum axial width 410*a* of a given protrusion 138*a* is less than a second maximum axial width 410*b* of another protrusion 138*a*, axially between to the given protrusions 138*a* and the second protrusions 138*b*. Likewise, the second maximum axial width 410*b* of a given protrusion 138*a* is less than a third maximum axial width 410*c* of another protrusion 138*a*, axially between to the given protrusions 138*a* and the second protrusions 138*b*. According to some embodiments, each protrusion has a maximum axial width proportional to its corresponding percent of the total load. Each protrusion 156*a* of the bridge 118 may have a corresponding and complementary shape and size. For example, a protrusion 156*a* may have a maximum axial width equal to the maximum axial width of the protrusion 138*a* contacted by the protrusion 156*a* with its engagement surface 454. Accordingly, the loads shared across engaged pairs of protrusions 138*a* and 156*a* may be accommodated by complementary shapes and geometries. Alternatively, the protrusions 156*a* may all have equal maximum axial widths, while the maximum axial widths of the protrusions 138*a* may vary.

It has further been found that, for at least some modules, a protrusion other than the protrusion closest to a source of a load bears the greatest proportion of the total load. For example, the following percent loads were measured for a module 104 having four protrusions, numbered in order of increasing distance from a set of protrusions of a neighboring module 106 to which the module 104 was coupled:

TABLE 2

| Percent Load per Protrusion of Intermediate Module 104 (male) | |
|---|---|
| Protrusion 138b (#) | Load (% of Total) |
| 1 | 20 |
| 2 | 30 |
| 3 | 28 |
| 4 | 22 |
| Total | 100 |

As shown, the distribution of load shown in Table 2 was more even than in the distribution shown in Table 1. In such cases, the maximum axial widths 410*d*, 410*e*, and 410*e* of the protrusions 138*b* may still vary according to the load distribution. According to some embodiments, each protrusion has a maximum axial width proportional to its corresponding percent of the total load. Each protrusion 156*b* of the bridge 118 may have a corresponding and complementary shape and size.

Notably, the protrusions having different maximum axial widths form annular rings. A threaded assembly requires uniform widths to allow threading and intimate engagement of complementary threading patterns. In contrast, embodiments having annular rings that do not follow helical paths may be engaged by a bridge without threading, and thereby allow a diversity of protrusion widths to engage the bridge simultaneously.

As discussed herein, when assembled, exemplary cement heads of the present disclosure are configured to support high axial loads from the weight of system components. The support surfaces of a given module are on axial sides of corresponding protrusions that face toward a connecting module. The engagement surfaces of a given module are on axial sides of corresponding protrusions that face away from the connecting module. Accordingly, the engagement surfaces of each module are positioned to receive an axial load from the bridge in a direction toward the connecting module. Each end of a module receives a unidirectional load, delivered to the engagement surfaces. The bridge provides axial loads to the different modules in opposite directions. Accordingly, the engagement surfaces of the different modules face in opposite directions.

When assembled, the exemplary cement heads of the present disclosure are configured to support high axial loads across a plurality of protrusions. The distribution of loads across protrusions may be non-uniform. Accordingly, the maximum axial width of each protrusion may be different from any other protrusion of the same module. The maximum axial width of each protrusion may be proportional to the corresponding percentage of the total load applied.

It is important to note that while multiple embodiments of a cement head have been disclosed above, each of the cement heads offer a simple method of joining modules together without the need to apply a substantial amount of torque to any of the modules, bridges, or retainers. While the assembly process for each of the above-disclosed embodiments of a cement head may require simple angular orienting about the central axis and/or matching up of modules to be connected, no torque or rotational force beyond the torque necessary to overcome inertial forces related to the modules themselves is necessary to complete the process of connecting adjacent modules. It will further be appreciated that the type of connection between modules described above may also be extended into use for other well service tools and apparatuses. Specifically, equivalents to the primary outer profiles, complementary profiles, bridges, and retainers may be used to join any other suitable tool or apparatus while still achieving the benefits of low or no torque required to make the connection.

To facilitate a better understanding of the present disclosure, the following examples of preferred or representative embodiments are given. In no way should the following examples be read to limit, or to define, the scope of the disclosure.

Embodiments disclosed herein include:

A. A cement head. The cement head includes a first module comprising a first end, a first outer surface, and a plurality of first protrusions extending radially outward from the first outer surface, each of the plurality of first protrusions comprising a first profile in which (i) a first engagement surface faces axially away from the first end and (ii) a first support surface forms a first oblique angle relative to an axis; and a bridge configured to engage the plurality of first protrusions.

B. A method of assembling a cement head. The method includes aligning a first module along an axis, the first module comprising a first end and a first protrusion having a first profile in which (i) a first engagement surface faces axially away from the first end and (ii) a first support surface forms a first oblique angle relative to the axis; and engaging a first complementary surface of a bridge with the first engagement surface.

C. A cement head. The cement head includes a first module comprising a first outer surface and a first plurality of protrusions extending radially outward from the first outer surface, wherein one of the first plurality of protrusions has a maximum axial width different from a maximum axial width of another of the first plurality of protrusions; and a bridge comprising a plurality of inner protrusions configured to engage the first plurality of protrusions wherein one of the plurality of inner protrusions has a maximum axial width different from a maximum axial width of another of the plurality of inner protrusions.

D. A method of assembling a cement head. The method includes aligning a first module along an axis; and engaging a bridge with first protrusions of the first module such that each of the first protrusions receives a corresponding portion of a total axial load via the bridge, and wherein each first outer protrusion has a corresponding maximum axial width proportional to the corresponding portion of the total axial load.

Each of embodiments A, B, C, and D may have one or more of the following additional elements in any combination: Element 1: a second module comprising a second end axially adjacent to the first end of the first module, a second outer surface, and a plurality of second protrusions extending radially outward from the second outer surface, wherein the bridge is further configured to engage the plurality of second protrusions. Element 2: wherein each of the plurality of second protrusions comprises a second profile in which (i) a second engagement surface faces axially away from the second end and (ii) a second support surface forms a second oblique angle relative to the axis. Element 3: wherein the first engagement surface is perpendicular to the first outer surface and wherein the second engagement surface is perpendicular to the second outer surface. Element 4: wherein the first support surface is non-parallel to the second support surface. Element 5: wherein each of the plurality of first protrusions comprises a base at the first outer surface and a top surface disposed (i) axially between the first engagement surface and the first support surface and (ii) radially outward from the first outer surface. Element 6: wherein a maximum axial width of the base is greater than a maximum axial width of the top surface. Element 7: wherein the plurality of first protrusions extend annularly about at least a portion of a circumference of the first module and wherein the plurality of second protrusions extend annularly about at least a portion of a circumference of the second module.

Element 8: aligning a second module along the axis, the second module comprising a second end axially adjacent the first end and a second protrusion having a second profile in which (i) a second engagement surface faces axially away from the second end and (ii) a second support surface forms a second oblique angle relative to the axis; and engaging a second complementary surface of the bridge with the second engagement surface, wherein a load of the first module is transferred to the second module via the bridge. Element 9: a second module comprising a second outer surface and a second plurality of protrusions extending radially outward from the second outer surface, wherein one the second plurality of protrusions has a maximum axial width different from a maximum axial width of another of the second plurality of protrusions, wherein the bridge is further configured to engage the second plurality of protrusions. Element 10: wherein the first plurality of protrusions comprises a first protrusion and a second protrusion disposed between the first protrusion and the second plurality of protrusions and having a maximum axial width greater than a maximum axial width of the first protrusion. Element 11: wherein the second plurality of protrusions comprises a third protrusion and a fourth protrusion, disposed between the third protrusion and the second plurality of protrusions and having a maximum axial width greater than a maximum axial width of the third protrusion. Element 12: wherein the first plurality of protrusions comprises a fifth protrusion between the second protrusion and the second plurality of protrusions, the fifth protrusion having a rectangular profile. Element 13: wherein the second plurality of protrusions comprises a sixth protrusion between the fourth protrusion and the first plurality of protrusions, the sixth protrusion having a rectangular profile. Element 14: wherein the second protrusion is disposed axially between the first protrusion and the second plurality of protrusions and wherein the fourth protrusion is disposed axially between the third protrusion and the first plurality of protrusions. Element 15: wherein each of the plurality of first protrusions comprises a first profile in which a first engagement surface faces axially away from the second module and a first support surface forms an oblique angle relative to the axis. Element 16: wherein each of the plurality of second protrusions comprises a second profile in which a second engagement surface faces axially away from the first module and a second support surface forms an oblique angle relative to the axis.

Element 17: wherein a corresponding portion of the total axial load received by one of the first outer protrusions is different from another corresponding portion of the total axial load received by another of the first outer protrusions. Element 18: wherein a maximum axial width of one of the first outer protrusions is different from another maximum axial width of another of the first outer protrusions. Element 19: aligning a second module along the axis and adjacent to the first module; and engaging the bridge with second protrusions of the second module such that each of the second protrusions receives a corresponding portion of a total axial load via the bridge, and wherein each second outer protrusion has a corresponding maximum axial width proportional to the corresponding portion of the total axial load.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A cement head, comprising:

a first module comprising a first end, a first outer surface, and a plurality of first protrusions extending radially outward from the first outer surface, each of the plurality of first protrusions comprising a first profile in which (i) a first engagement surface faces axially away from the first end and (ii) a first support surface forms a first oblique angle relative to an axis;

a first supplemental protrusion having a rectangular profile and extending radially outward from the first outer surface at a location between the first end and the plurality of first protrusions;

a second module comprising a second end axially adjacent the first end of the first module, a second outer surface, and a plurality of second protrusions extending radially outward from the second outer surface; and a second supplemental protrusion having a rectangular profile and extending radially outward from the second outer surface at a location between the second end and the plurality of second protrusions; and a bridge configured to engage the plurality of first protrusions, the first supplemental protrusion, the plurality of second protrusions, and the second supplemental protrusion, wherein the plurality of first protrusions comprises a first protrusion and a second protrusion disposed between the first protrusion and the plurality of second protrusions and having a maximum axial width greater than a maximum axial width of the first protrusion, and wherein the second plurality of protrusions comprises a third protrusion and a fourth protrusion disposed between the third protrusion and the first plurality of protrusions and having a maximum axial width greater than a maximum axial width of the third protrusion.

2. The cement head of claim 1, wherein each of the plurality of second protrusions comprises a second profile in which (i) a second engagement surface faces axially away from the second end and (ii) a second support surface forms a second oblique angle relative to the axis.

3. The cement head of claim 2, wherein the first engagement surface is perpendicular to the first outer surface and wherein the second engagement surface is perpendicular to the second outer surface.

4. The cement head of claim 2, wherein the first support surface is non-parallel to the second support surface.

5. The cement head of claim 2, wherein the plurality of first protrusions extend annularly about at least a portion of a circumference of the first module and wherein the plurality of second protrusions extend annularly about at least a portion of a circumference of the second module.

6. The cement head of claim 1, wherein each of the plurality of first protrusions comprises a base at the first outer surface and a top surface disposed (i) axially between the first engagement surface and the first support surface and (ii) radially outward from the first outer surface.

7. The cement head of claim 6, wherein a maximum axial width of the base is greater than a maximum axial width of the top surface.

8. A method, comprising:

aligning a first module along an axis, the first module comprising a first end and a plurality of first protrusions each having a first profile in which (i) a first engagement surface faces axially away from the first end and (ii) a first support surface forms a first oblique angle relative to the axis, the first module further comprising a first supplemental protrusion having a rectangular profile and being located between the first end and the plurality of first protrusions;

aligning a second module along the axis, the second module comprising a second end axially adjacent the first end and a plurality of second protrusions each having a second profile in which (i) a second engagement surface faces axially away from the second end and (ii) a second support surface forms a second oblique angle relative to the axis, the second module further comprising a second supplemental protrusion having a rectangular profile and being located between the second end and the plurality of second protrusions;

engaging a first complementary surface of a bridge with the first engagement surface and engaging a second complementary surface of the bridge with the second engagement surface;

receiving the first supplemental protrusion in a first recess defined on the bridge and receiving the second supplemental protrusion in a second recess defined on the bridge; and transferring a load of the first module to the second module via the bridge, wherein the plurality of first protrusions comprises a first protrusion and a second protrusion disposed between the first protrusion and the plurality of second protrusions and having a maximum axial width greater than a maximum axial width of the first protrusion, and wherein the second plurality of protrusions comprises a third protrusion and a fourth protrusion disposed between the third protrusion and the first plurality of protrusions and having a maximum axial width greater than a maximum axial width of the third protrusion.

9. The method of claim 8, wherein the first module comprises a first outer surface and the second module comprises a second outer surface, and wherein the first engagement surface is perpendicular to the first outer surface and the second engagement surface is perpendicular to the second outer surface.

10. The method of claim 8, wherein the first support surface is non-parallel to the second support surface.

11. A cement head, comprising:

a first module comprising a first outer surface and a plurality of first protrusions extending radially outward from the first outer surface;

a first supplemental protrusion having a rectangular profile and extending radially outward from the first outer surface;

a second module alignable with the first module and comprising a second outer surface and a plurality of second protrusions extending radially outward from the second outer surface;

a second supplemental protrusion having a rectangular profile and extending radially outward from the second outer surface; and a bridge comprising a plurality of inner protrusions configured to engage the pluralities of first and second protrusions and the first and second supplemental protrusions, wherein one of the plurality of inner protrusions has a maximum axial width different from a maximum axial width of another of the plurality of inner protrusions, wherein the plurality of first protrusions comprises a first protrusion and a second protrusion disposed between the first protrusion and the plurality of second protrusions and having a maximum axial width greater than a maximum axial width of the first protrusion, and wherein the second plurality of protrusions comprises a third protrusion and a fourth protrusion disposed between the third protrusion and the first plurality of protrusions and having a maximum axial width greater than a maximum axial width of the third protrusion.

12. The cement head of claim 11, wherein each of the plurality of first protrusions comprises a first profile in which a first engagement surface faces axially away from the second module and a first support surface forms an oblique angle relative to an axis, and wherein each of the plurality of second protrusions comprises a second profile in which a second engagement surface faces axially away from the first module and a second support surface forms an oblique angle relative to the axis.

13. A method, comprising:

aligning a first module along an axis, the first module comprising a first outer surface and a plurality of first protrusions extending radially outward from the first outer surface, the first module further comprising a first supplemental protrusion having a rectangular profile and extending radially outward from the first outer surface;

aligning a second module along the axis adjacent the first module, the second module comprising a second outer surface and a plurality of second protrusions extending radially outward from the second outer surface, the second module further comprising a second supplemental protrusion having a rectangular profile and extending radially outward from the second outer surface;

engaging a plurality of inner protrusions of a bridge with the pluralities of first and second protrusions and the first and second supplemental protrusions;

transferring a load of the first module to the second module via the bridge, wherein the plurality of first protrusions comprises a first protrusion and a second protrusion disposed between the first protrusion and the plurality of second protrusions and having a maximum axial width greater than a maximum axial width of the first protrusion, and wherein the second plurality of protrusions comprises a third protrusion and a fourth protrusion disposed between the third protrusion and the first plurality of protrusions and having a maximum axial width greater than a maximum axial width of the third protrusion.

14. The method of claim 13, wherein a portion of a total axial load received by one of the plurality of first protrusions is different from another portion of the total axial load received by another of the plurality of first protrusions.

15. The method of claim 13, wherein one of the plurality of inner protrusions has a maximum axial width different from a maximum axial width of another of the plurality of inner protrusions.

* * * * *